US005310150A

United States Patent [19]

Fecko

[11] Patent Number: 5,310,150

[45] Date of Patent: May 10, 1994

[54] TREE MOUNTED ARCHERY BOW HOLDER

[76] Inventor: Robert J. Fecko, 28766 Apollo, Chesterfield, Mich. 48047

[21] Appl. No.: 963,595

[22] Filed: Oct. 20, 1992

[51] Int. Cl.[5] ..... F16B 45/00

[52] U.S. Cl. ..... 248/218.2; 248/217.4; 411/400

[58] Field of Search ..... 248/217.4, 216.1, 218.1, 248/218.2; 411/400, 401, 409, 388, 389, 919

[56] References Cited

U.S. PATENT DOCUMENTS

| | | | |
|---|---|---|---|
| 396,757 | 1/1889 | Miles . | |
| 1,780,181 | 11/1930 | Fassen | 248/218.2 |
| 3,991,780 | 11/1976 | Maroski, Jr. | 135/66 |
| 4,542,873 | 9/1985 | Matherly et al. | 248/218.4 |
| 4,636,125 | 1/1987 | Burgard | 411/389 |
| 4,708,221 | 11/1987 | Kubiak | 182/187 |
| 4,729,363 | 3/1988 | Skyba | 124/23 R |
| 4,856,953 | 8/1989 | Lin | 411/383 |
| 4,889,307 | 12/1989 | Klansek | 248/690 |
| 4,936,415 | 6/1990 | Williams | 182/187 |
| 5,039,052 | 8/1991 | Carafice | 248/309.1 |
| 5,044,590 | 9/1991 | Carafice | 248/309.1 |
| 5,076,522 | 12/1991 | Stinson | 248/216.1 |
| 5,106,044 | 4/1992 | Regard, III et al. | 248/169 |
| 5,114,107 | 5/1992 | Mann et al. | 248/217.4 |
| 5,207,404 | 5/1993 | Reinhard | 248/217.4 |

*Primary Examiner*—Richard K. Seidel
*Assistant Examiner*—Hwei-Siu Payer
*Attorney, Agent, or Firm*—Basile and Hanlon

[57] ABSTRACT

An archery bow holder removably supports an archery bow in an upright position in front of a hunter located in a tree stand or adjacent a tree trunk. The archery bow holder includes a tubular member having first and second ends. Screw threads are formed at the first end of the tubular member for attaching the tubular member to a tree trunk. The tubular member has a predetermined length sufficient to position the second end of the tubular member in front of a hunter located adjacent a tree trunk in which the tubular member is mounted. A hook formed of a short leg extending generally perpendicular to the second end of the tubular member and terminating in a short upright arm is formed on the second end of the tubular member to receive and support one end of an archery bow.

7 Claims, 1 Drawing Sheet

TREE MOUNTED ARCHERY BOW HOLDER

BACKGROUND OF THE INVENTION

1. Field of the Invention

The present invention relates, in general, to archery bows and, more specifically, to archery bow holders for field use.

2. Description of the Art

Bow hunters frequently use a blind, such as an elevated tree stand, to provide an unobstructed field of view of an area traversed by game animals and to place the hunter above the normal horizontal line of sight of such animals. As hunters may wait for many hours for game animals to approach the blind, most hunters desire to have a convenient holder to temporarily store an archery bow while not in use. Such a bow holder must also enable the hunter to quickly retrieve the bow and to bring the bow and arrow into a firing position.

Since a conventional tree stand includes a foot platform and a seat, various bow holders have been devised for attachment to the front edge of the platform. These holders receive the lower end of one of the bow limbs to support the bow in a generally upright, vertical position. However, such a mounting arrangement is subject to inadvertent release of the bow from the holder if the bow is inadvertently touched by the hunter or due to a gust of wind. Other bow holders are of a makeshift variety and employ nails or hooks which are attached to tree limbs or tree trunks to temporarily hold an archery bow. However, the availability of tree limbs at the proper position in front of the hunter is not always possible, particularly where the hunter desires to position the tree stand with an unobstructed field of view in front of the stand.

Furthermore, temporarily mounting bows by means of hooks or nails to tree trunks positions the bow in a location which is not easy for the hunter to quickly reach and one which requires excessive movement by the hunter in reaching for the bow which may startle the game animal.

Thus, it would be desirable to provide an archery bow holder which overcomes the deficiencies of previously devised bow holders for use in the field. It would also be desirable to provide an archery bow holder which positions the bow at an easily retrievable position in front of a hunter located in a tree stand. It would also be desirable to provide an archery bow holder which securely retains the bow in a storage position and which enables a hunter to easily and quickly remove the bow from the holder without excessive movement. It would also be desirable to provide an archery bow holder which is easily mountable and dismountable from a tree trunk.

SUMMARY OF THE INVENTION

The present invention is a tree mounted archery bow holder for temporarily holding an archery bow in a generally upright position in front of a hunter located adjacent to a tree or in an elevated tree stand.

The tree mounted archery bow holder of the present invention includes an elongated tubular member having first and second opposed ends. Means are formed on the first end of the tubular member for removably mounting the tubular member to a tree trunk such that the tubular member extends substantially horizontally outward from the tree trunk. A hook means is connected to and extends from the second end of the tubular member for releasably supporting an archery bow thereon in a generally upright or vertical position.

In a preferred embodiment, the mounting means comprises screw threads formed on the first end of the tubular member which are releasably threadable into a tree trunk. A handle means may optionally be mounted on the tubular member adjacent the first end thereof. The handle means extends transversely to the longitudinal axis of the tubular member to provide a means for driving the screw threads on the tubular member into a tree trunk.

In a preferred embodiment, the hook means comprises a first leg extending laterally from the second end of the tubular member substantially perpendicular to the longitudinal axis of the tubular member and an arm connected to and extending substantially perpendicular from an outer end of the leg. Preferably, the leg is disposed co-planar with the tubular member. Further, in a preferred embodiment, the leg, the arm and the tubular member are integrally formed as a one-piece, unitary member.

The tubular member has a predetermined length so as to support an archery bow on the hook means attached to the second end thereof in front of a hunter positioned adjacent to a tree trunk in which the first end of the tubular member is mounted.

The tree mounted archery bow holder of the present invention overcomes certain of the deficiencies encountered with previously devised archery bow holders for use in the field during hunting. The archery bow holder of the present invention is easily mountable and dismountable from a tree trunk. The tubular member of the present archery bow holder has a predetermined length so as to support one end of an archery bow in an upright position in front of a hunter located in a tree stand or adjacent a tree trunk. This enables the hunter to easily remove the archery bow from the holder with only a small hand movement and to bring the archery bow immediately into a firing position. This eliminate any excess movement in retrieving the bow which may startle animals. Finally, the archery bow holder is simple in construction for a low manufacturing cost.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is a tree mounted archery bow holder for releasably holding and positioning an archery bow in a storage position directly in front of a hunter located adjacent a tree trunk or in an elevated tree stand which enables the hunter to easily retrieve and immediately bring the archery bow into a firing position without excessive movement.

Figure 1:
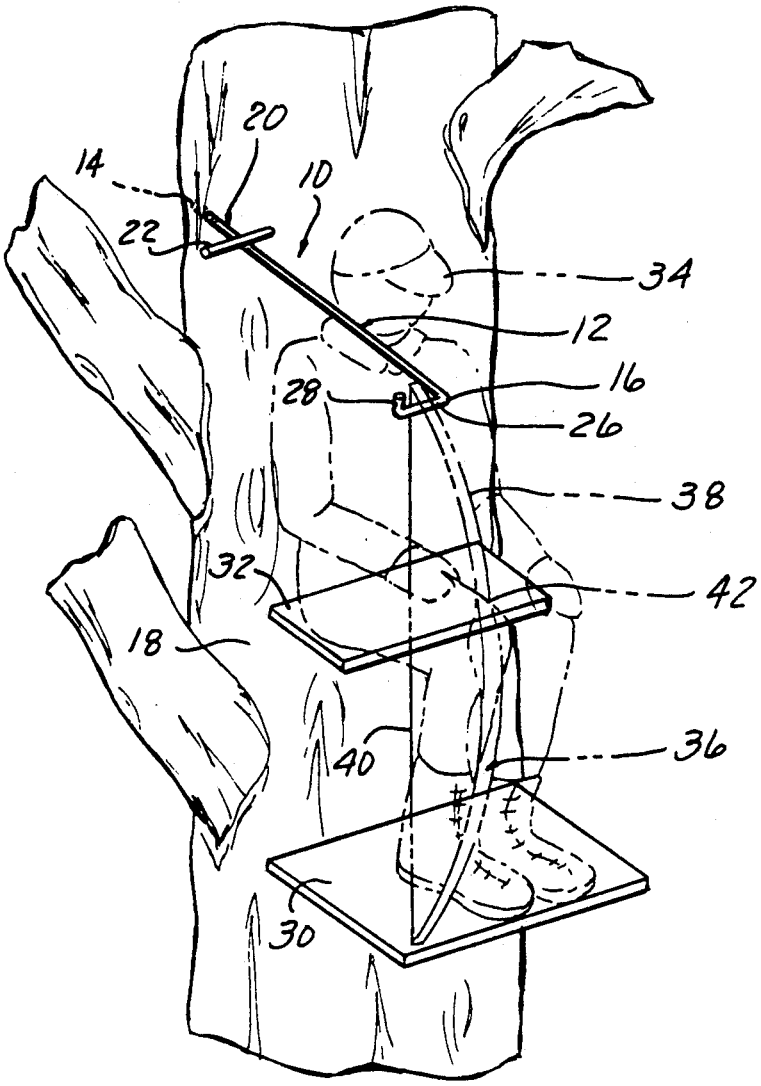
FIG. 1 is a perspective view showing an archery bow holder of the present invention in conjunction with an elevated tree stand.
Figure 3:
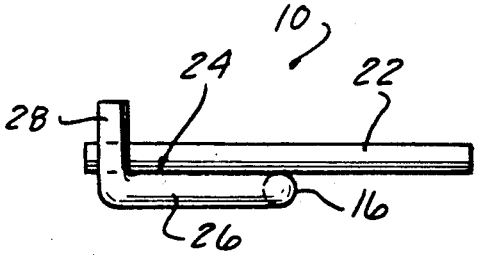
FIG. 3 is a right-hand end view of the archery bow holder shown in FIG. 2.
Figure 2:
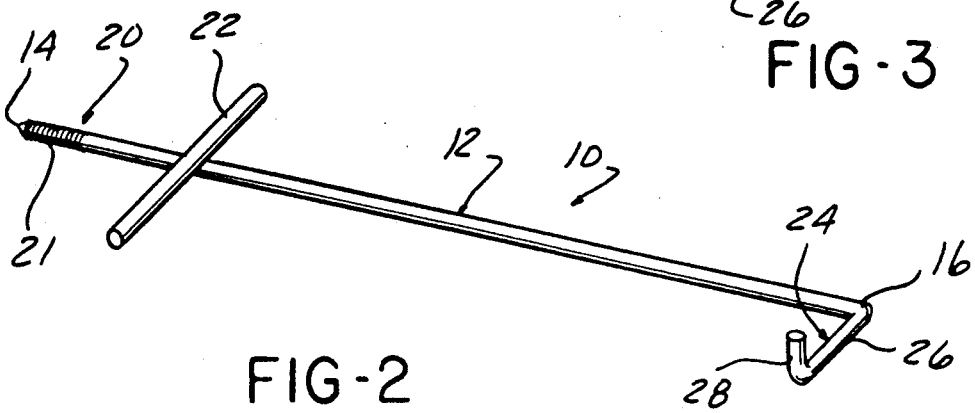
FIG. 2 is a perspective view of the archery bow holder of the present invention.

As shown in FIGS. 1–3, the archery bow holder 10 of the present invention includes an elongated tubular member 12 having opposed first and second ends 14 and 16, respectively. The tubular member 12 may have any cross sectional shape, such a circular, square, etc. Preferably, a circular cross section, steel drill rod is employed to form the tubular member 12.

In a preferred embodiment, the tubular member 12 has a predetermined length between the first and second ends 14 and 16 so as to position the second end 16 at a predetermined distance from a tree trunk 18, shown in FIG. 1, when the first end 14 of the tubular member 12 is securely mounted in the tree trunk 18, as described hereafter. By way of example only, the tubular member 12 is provided in a length between twelve and eighteen inches between the first and second ends 14 and 16, with a length of 17.75 inches being preferred.

A mounting means denoted generally by reference number 20 is formed on the first end 14 of the tubular member 12 for releasably mounting the tubular member 12 into a tree trunk 18. Although the mounting means 20 may simply comprise a pointed end which is driven, in a similar manner as a nail, into the tree trunk 18, preferably, the mounting means 20 comprises screw threads 21 formed on the first end 14 of the tubular member 12. The screw threads 21 are threaded into the tree trunk by rotating the tubular member 12. An optional handle 22 may be securely attached to the tubular member 12, at a location adjacent to, but spaced from the first end 14 to aid in rotating the tubular member 12 to screw the threads 21 into a tree trunk 18 or to unscrew the tubular member 12 from a mounting position in a tree trunk 18. The handle 22 preferably comprises a short length drill rod which is welded or otherwise secured in a transverse or perpendicular position on the tubular member 12.

A hook means denoted by reference number 24 is connected to the second end 16 of the tubular member 12. Preferably, the hook means 24 includes a leg 26 which extends from the second end 16 of the tubular member 12, generally perpendicular to the longitudinal axis of the tubular member 12. The leg 26 has a short length, such as approximately 1.75 inches, by way of example only. An arm 28 is connected to an outer end of the leg 26 and extends generally perpendicular from the leg 26. Preferably, the leg 26 is co-planar with the tubular member 12 such that the arm 28 extends perpendicularly upward from the co-planar arranged tubular member 12 and leg 26. It will be understood that the leg 26 may take other shapes, such as a concave or V-shape, etc.

In a preferred embodiment, the tubular member 12, the leg 26 and the arm 28 are integrally formed as a one-piece, unitary member. The leg 26 and arm 28 are formed at one end of the tubular member 12 by means of bending the end of the tubular member 12 into the desired shape to form the leg 26 and the arm 28.

Furthermore, the entire bow holder 10, including the tubular member 12, the handle 22, the leg 26 and the arm 28 are coated with a layer of a protective material, such as plastic. Such a coating may be formed by dipping the entire bow holder 10 into a molten plastic and then allowing the plastic to harden or cure.

The archery bow holder 10 of the present invention is advantageously used with an elevated tree stand, generally shown in FIG. 1 as including a foot platform 30 and a seat 32. The platform 30 and seat 32, which do not form part of the present invention, are secured to a tree trunk in a known manner to enable a hunter 34 to sit on the tree stand at an elevated position adjacent a tree trunk 18.

The archery bow holder 10 is mounted in the tree trunk 18 by screwing the threads 21 into the tree trunk 18 at a desired location, preferably over the shoulder and immediately adjacent one side of the head of the hunter 34 when the hunter 34 is seated on the seat 32. Due to the predetermined length of the tubular member 12 of the bow holder 10, the second end 16 of the tubular member 12 having the hook means 24 connected thereto is positioned immediately in front of the hunter 34 on the tree stand. The leg 26 and arm 28 are designed to support one end of a conventional archery bow 36, such as a standard archery bow, a compound bow, etc. The archery bow 36 is releasably mounted over the leg 26 of the bow holder 10 and is supported in a generally upright or vertical position, as shown in FIG. 1 at the nock point between one of the archery bow limbs 38 and the bow string 40. This positioning of the archery bow 36 in front of the hunter 34 places the hand grip 42 of the archery bow 36 in close proximity to the hand of the hunter 34 when the hunter 34 is seated on the seat 32. This enables the hunter 34, when he or she desires to use the archery bow 36, to merely grab the handle or grip 42 and, with a slight hand movement, raise the upper end of the archery bow 36 off of the leg 26 of the bow holder 10 and over the upstanding arm 28 so as to be able to bring the archery bow 36 directly and immediately into a firing position.

The upstanding arm 28 in conjunction with the tubular member 12 functions to securely retain the archery bow 36 on the holder 10 such that the archery bow 36 is not susceptible to unwanted release from the holder 10 when inadvertently touched by the hunter 34 or due to a gust of wind.

In summary, there has been disclosed a unique tree mounted archery bow holder which temporarily supports an archery bow immediately in front of a hunter positioned adjacent a tree trunk or in an elevated tree stand. The archery bow holder of the present invention is simple in construction for a low manufacturing cost and is easily mountable in and dismountable from a tree trunk. The primary advantage of the present archery bow holder is that it positions an archery bow immediately in front of a hunter so as to enable the hunter to quickly and easily grasp and release the archery bow from the holder without excessive movement and to bring the archery bow immediately into a firing position.

What is claimed is:

1. A tree mounted archery bow holder comprising:

an elongated tubular member having first and second opposed ends and a longitudinal axis:

means, formed on the first end of the tubular member, for removably mounting the tubular member on a tree trunk such that the tubular member extends outward from the tree trunk; and hook means, connected to and extending from the second end of the tubular member, for releasably supporting an archery bow thereon, the hook means including:

a leg extending co-planarly from the second end of the tubular member substantially perpendicular to the longitudinal axis of the tubular member; the tubular member and the leg lying in a first plane; and an arm extending substantially perpendicular from the leg and the first plane.

2. The archery bow holder of claim 1 wherein the mounting means comprises:

screw threads formed on the first end of the tubular member.

3. The archery bow holder of claim 1 wherein the mounting means further comprises:

a handle, attached to the tubular member adjacent the first end thereof and extending transverse to the longitudinal axis of the tubular member.

4. The archery bow holder of claim 1 wherein:

the leg, the arm and the tubular member are integrally formed as a one-piece unitary member.

5. The archery bow holder of claim 1 wherein:

substantially all of the tubular member, the leg and the arm are covered with a protective coating.

6. The archery bow holder of claim 1 wherein:

the tubular member has a predetermined length so as to position the hook means at the second end of the tubular member at the predetermined length from at tree trunk when the first end of the tubular member is mounted in a tree trunk to support an archery bow on the hook means in front of a hunter positioned adjacent a tree trunk in which the first end of the tubular member is mounted.

7. A tree mounted archery bow holder comprising:

an elongated tubular member having first and second opposed ends and a longitudinal axis;

screw threads formed on the first end of the tubular member for removably mounting the tubular member in a tree trunk such that the tubular member extends outward from the tree trunk;

a handle attached to the tubular member adjacent the first end thereof and extending transverse to the longitudinal axis of the tubular member;

a leg extending co-planarly from the second end of the tubular member substantially perpendicular to the longitudinal axis of the tubular member, the tubular member and the leg lying on a first plane;

an arm extending substantially perpendicular from an end of the leg and the first plane;

the tubular member, the leg and the arm being integrally formed as a unitary one-piece member; and the tubular member having a predetermined length so as to position the leg and the arm extending from the second end thereof at a predetermined distance from a tree trunk when the first end of the tubular member is mounted in the tree trunk to support and archery bow on the leg between the second end of the tubular member and the arm in front of a hunter positioned adjacent the tree trunk in which the first end of the tubular member is mounted.

* * * * *

UNITED STATES PATENT AND TRADEMARK OFFICE

CERTIFICATE OF CORRECTION

PATENT NO. : 5,310,150

DATED : May 10, 1994

INVENTOR(S) : Robert J. Fecko

It is certified that error appears in the above-identified patent and that said Letters Patent is hereby corrected as shown below:

Col. 5, claim 6, line 21, delete "at" and insert --a--.

Claim 7, line 22, delete "and" and insert --an--.

Signed and Sealed this

Sixteenth Day of August, 1994

*Attest:*

*Attesting Officer*

BRUCE LEHMAN

*Commissioner of Patents and Trademarks*